United States Patent [19]

Silka et al.

[11] 4,360,403

[45] Nov. 23, 1982

[54] METHOD OF CHARGING COKE OVENS WITH COAL

[76] Inventors: Adolf N. Silka, ulitsa Kostomirovskaya, 5/7, kv. 15; Alexandr N. Minasov, ulitsa Ivanova, 12/16, kv. 59; Nikolai K. Kulakov, ulitsa Akademika Pavlova, 132, kv. 223; Evgeny P. Likhogub, ulitsa Slinko, 2a, kv. 11; Gersh A. Dorfman, ulitsa Dmitrievskaya, 20, kv. 10, all of Kharkov; Alexandr A. Azimov, ulitsa Oktyabrskoi revoljutsii, 25, kv. 11, Slavyansk Donetskoi oblasti; Vladimir M. Davydenko, ulitsa Oktyabrskoi revoljutsii, 45/9, kv. 5, Slavyansk Donetskoi oblasti; Gennady N. Marapulets, ulitsa Lyzenko, 40, Slavyansk Donetskoi oblasti; Valentin A. Shestakov, ulitsa Marochnaya, 34, kv. 11; Nikolai F. Gromov, ulitsa Promyshlennaya, 74, kv. 2, both of Kemerovo, all of U.S.S.R.

[21] Appl. No.: 263,401

[22] Filed: May 14, 1981

Related U.S. Application Data

[62] Division of Ser. No. 156,376, Jun. 4, 1980, abandoned.

[30] Foreign Application Priority Data

Nov. 17, 1975 [SU] U.S.S.R. ..... 2320862

[51] Int. Cl.[3] ..... C10B 31/04; C10B 45/00

[52] U.S. Cl. ..... 202/263; 201/40; 414/163; 414/199

[58] Field of Search ..... 201/40, 41; 202/254–263; 414/163, 199

[56] References Cited

U.S. PATENT DOCUMENTS

| | | | |
|---|---|---|---|
| 2,975,109 | 3/1961 | Van Ackeren | 202/255 |
| 3,435,596 | 4/1969 | Hornung | 414/163 |
| 3,537,957 | 11/1970 | Wagner et al. | 202/263 |
| 3,647,053 | 3/1972 | Palumbo | 414/163 |
| 3,767,536 | 10/1973 | Ikeda et al. | 414/163 |
| 4,071,414 | 1/1978 | Fidchvnov et al. | 201/40 |
| 4,157,940 | 6/1979 | Watson | 201/41 |
| 4,189,272 | 2/1980 | Gregor et al. | 414/199 |
| 4,197,165 | 4/1980 | Knappstein et al. | 202/262 |
| 4,314,889 | 2/1982 | Kwasnik et al. | 202/263 |

FOREIGN PATENT DOCUMENTS 778754 7/1957 United Kingdom .

*Primary Examiner*—Bradley Garris

*Attorney, Agent, or Firm*—Burgess, Ryan and Wayne

[57] ABSTRACT

A method of charging coke ovens with coal through charging holes and simultaneously withdrawing gases evolving from the coal charge through the middle charging holes thereof, holding the coal charge over a period of time sufficient for a coal-charging machine to deliver a next batch of said coal charge for charging the next successive coke oven, completely charging said coke oven while simultaneously charging the next successive coke oven through its extreme charging holes, and withdrawing through said middle charging holes of said coke oven being completely charged, said coke-oven gases and introducing a gas inert to said coke-oven gas in an amount of 15–20% of the total amount of the coke-oven gas being withdrawn.

There is also provided a coal-charging machine for carrying out this method comprising a frame with undercarriages, hoppers for containing the coal charge, the number of hoppers corresponding to the number of the charging holes of the coke oven, coal feed devices disposed in the upper portion of the hoppers.

2 Claims, 14 Drawing Figures

METHOD OF CHARGING COKE OVENS WITH COAL

This is a division of application Ser. No. 156,376, filed June 4, 1980, now abandoned.

BACKGROUND OF THE INVENTION

1. Field of the Invention

The present invention relates to a method of charging coke ovens with coal and a coal-charging machine to carry out the same. The invention is applicable in the coking-by-product industry.

Most advantageously this invention can be used for smokeless charging of horizontal coke ovens.

2. Description of the Prior Art

The method for charging coke ovens which is most extensively used at present consists in alternately charging coal to the coke ovens in a predetermined sequence through the charging holes in the oven roof (Nepomniastchiy I.L., Koksovye mashiny, ih konstrukzyi i raschet, Moskva, Metallurgizdat, pp. 135–137).

The number of charging holes in each coke oven, depends on the size thereof and the characteristics of the coal charged, and may be three or four or, more rarely, more than four. Several dozen coke ovens are installed side-by-side and parallel with each other to form a coke-oven battery. Coal from a coal bin generally positioned between two coke-oven batteries is discharged into the hoppers of a coal-charging machine which brings the coal charge to the coke ovens. The coal-charging machine travels on rails laid on the top of the coke ovens along the coke-oven battery. The number of hoppers on the coal-charging machine generally corresponds to the number of charging holes in the coking chamber, the hoppers being arranged on the coal-charging machine in one row parallel to the coking chamber axis (or perpendicular to the longitudinal axis of the coke-oven battery). Normally, one coking chamber is charged at one loading of the coal charging machine.

Discharging the coal from the hoppers of a coal-charging machine to the coking chamber, i.e. charging the coking chamber is one of the most important and elaborate operations. Since the walls of a coking chamber in which the coal charge is placed are at a temperature higher than 1000° C. the coal charge, as a result of the decomposition of the coal begins to intensely evolve a considerable amount of gases. These gases carry along into the atmosphere, or gas collectors a great deal of dust. At the same time in the charging zone there is formed a dangerously explosive gas-and-dust mixture, which may explode or cause the coal charge to ignite.

In order to prevent, or, at least, decrease the amount of the dust discharged into the atmosphere and carried into the gas collectors communicating with the coking chambers through ascension pipes, there have been applied different methods, such as for example, those procedures which avoid the discharge of the coke-oven gas, dust and coal particles into the atmosphere or alternatively discharging the coal charge from the hoppers of a coal-charging machine (cf. U.S. Pat. No. 3,542,650).

Discharging the coal from the coal-charging machine, is normally done as follows: the coal is discharged first from one of the extreme hoppers, then from the other (i.e. opposite) outer hopper, and finally from the middle one. (In case the latter has three hoppers). In the case of four, five or more hoppers the discharging succession is the same, discharging coal from the next hopper being started after the previous one has been completely emptied. Pouring from the hopper into the coking chamber, the coal piles up therein forming a cone-shaped pile with an angle of rest, the crest of the pile facing the centre of the charging hole. As a result, within the coaking chamber there remain unfilled zones wherein partially settle coal dust, and wherethrough to the ascension pipes are passed the gases evolving from the coal during the charging, thereby precluding the formation of explosive mixture of dust and gas in the charging zone.

The coal in the coking chamber is then levelled by means of a leveling bar mounted on the pusher ram and being introduced into the coking chamber through a port provided in the door located on the coke pusher side of the coking chamber. The opposite side of the coking chamber is called a coke discharge side.

To prevent the gases containing coal dust from passing into the collection mains the latter are cut off from the coking chamber by means of valves mounted in the ascension pipes, and the said gas is discharged into the atmosphere through outlets provided in the ascension pipes by opening the covers shutting these outlets. Thus, the gases evolving from the coal being charged are discharged through the ascension pipes into the atmosphere, which, however does not exclude the danger of ignition or explosion of the said gases immediately above the ascension pipes when they are discharged into the atmosphere.

The danger of gas explosion or ignition can be reduced by speeding up the gas discharging which is achieved by ejecting steam or water in the direction of the gas discharge (A. B. Hadjioglo et al. Bezdymnaya zagruzka koksovyh pechei. Moskva, "Metallurgiya," 1978, pp. 47–48). However, this method remedies the problem only partially.

To improve the explosion safety of the charging operation effected in the above sequence, the gases evolving from the coal charge during the charging thereof are passed to a gas-purifying apparatus (cf. Patent of Japan No. II, 987/67).

The disadvantage of this method lies in that the gas flow crosses the flow of coal being charged. In addition, a considerable amount of coal particles are entrained by the gases being withdrawn and is burned therewith. This not only causes a loss of the coal charge but also increases operating load of the burning chamber, and causes the latter to be clogged with ash and slag without remedying the problem of eliminating the danger of explosion.

It is known that attempts have been made to decrease explosion hazard by changing coke ovens through pipes with the aid of a carrier such as steam, inert gases, etc. (cf. U.S. Pat. Nos. 3,047,473; 3,432,398; 3,374,151, and French Pat. No. 2,084,051).

In practice, however, the coal to be charged through pipes must be preliminary dried, in which case the dried coal becomes liable to start burning and explode. Therefore, this method does not yield desirable results.

Furthermore, together with the coal charge a large amount of the carrier gas is blown into the coking chamber. The carrier gas is at a lower temperature than the temperature within the coking chamber. The large amount of cold gases not only causes the coke oven to be prematurely rendered inoperative because of sharp temperature changes, but greatly increases the amount of gases and dust to be withdrawn from the coking chamber. In addition, the apparatus for carrying out this method features a rather complex construction.

There is also known a method of charging coke ovens with coal (U.S. Pat. No. 4,071,414), which comprises pouring coal through the extreme charging holes of the coking chambers and simultaneously withdrawing the gases evolving from the coal being charged, holding the coal charge over a time period sufficient for a coal-charging machine to deliver a next batch of coal to the next coking chamber to be charged which is to be completely charged through its middle charging holes while simultaneously withdrawing the gases evolving from the coal being charged, completely charging the coking chamber simultaneously with the charging of the next successive coking chamber through the extreme charging holes thereof. The gases evolving from the coal charge during the charging thereof are withdrawn through ascension pipes disposed on the both sides of each coking chamber, i.e. the coke pusher side and the coke discharge side. The direction of the gas flow in the coking chamber is periodically changed: when the coal is poured from the extreme hopper located on the coke pusher side of the coke oven battery, the gases are withdrawn through the ascension pipe located on the coke discharge side, and on the contrary, when the coal is discharged from the extreme hopper located on the coke discharge side the gases are removed through the ascension pipes on the coke pusher side of the coke oven battery.

The above method of charging coke ovens, in comparison with the aforementioned ones, somewhat reduces the probability of formation of the dangerously explosive mixtures of gas and dust within the charging zone due to a reduced amount of dust entrained by the gas being withdrawn. In addition, the above process of two-step (charging and then completely charging) charging coke ovens in comparison with the conventional ones takes less time, which results in a smaller amount of gases being evolved and, hence, a smaller amount of coal particles and dust are entrained thereby and discharged into the atmosphere. With two coking chambers charged simultaneously, the flow of the gas and the coal charge is distributed so that the rate of formation of the coal dust at the moment of the coal being discharged from the hoppers is reduced. Furthermore, during the holding period taking place between the two successive charging operations the coal charge in the coking chamber becomes more compacted, which in turn improves the efficiency of the charging process.

The above-mentioned Patent also discloses a coal-charging machine comprising hoppers disposed on a frame mounted on carriages: the extreme end hoppers for charging one coking chamber through the extreme end charging holes thereof and the middle hoppers for completely charging through the central charging holes the other coking chamber already partially charged through its extreme charging holes. The hoppers have in their upper part a feed means wherethrough the coal is passed from the coal bin into them, and in their lower part discharge means wherethrough the coal is passed from them into the coaking chambers. The gases evolved from the coal charge during the charging thereof are withdrawn through the ascension pipes located both on the coke pusher side and the coke discharge side of the coking chamber. The centres of the discharging holes of the extreme end hoppers are displaced relative the centres of the discharging holes of the middle hoppers for a value equal to the distance between the longitudinal axis of the coking chamber being charged and of the coking chamber being completely charged. This permits the charging cycle to be reduced at the expense of simultaneously carrying out said operations without additional maneuvering the coal charging machine relative to the coking chambers being charged. In addition, as have been already mentioned, the amount of gases discharged into the atmosphere is also reduced since with the two-step charging method the coking chamber is cut off from the gas collection system and communicates with the atmosphere for a shorter period of time. Therefore, the amount of air which gets inside the coking chamber during the charging thereof and which forms together with the coke gas an explosion mixture is also reduced.

However, the discharge of gases through ascension pipes which communicate with the atmosphere does not exclude the possibility of ingress of the air into the coking chamber and hence the formation of the dangerously explosive gas and coal dust mixture within the coal charging zone. Furthermore, at some coking-by-product plants the content of nitrogen oxides in the gases being withdrawn exceeds allowable ones, which limits the application of the coke-oven gas. For instance, using coke-oven gases with a high content of nitrogen oxides in the production of nitrogen fertilizer may be a cause of explosion.

SUMMARY OF THE INVENTION

The principal object of the invention is to provide a method of charging coke ovens with coal and a coal-charging machine for carrying out the charging, which ensures the explosion safety of the coke-oven gas with a simple construction of the coal-charging machine and a highly efficient process for smokeless charging of coke ovens.

Another object of the invention is to provide a high quality coke-oven gas for the use in the nitrogen fertilizer production.

These and the other objects of the invention are attained in a method of charging coke ovens with coal, which comprises charging the coal through extreme charging holes while simultaneously withdrawing gases evolving from the coal being charged, holding the coal charge over a time period sufficient for a coal-charging machine to deliver a next batch of the coal charge for charging of the next successive coking chamber and complete charging of the coking chamber through the middle charging holes while simultaneously withdrawing gases evolved from the coal being charged, the complete charging of the coking chamber being effected simultaneously with charging the next successive coking chamber through the extreme end charging holes thereof, and wherein according to the invention withdrawing of gases during the charging of the coking chamber through its extreme end charging holes is effected through the middle charging holes thereof, and the complete charging of the coking chamber through the middle charging holes is effected simultaneously with the withdrawing of the coke-oven gases through the middle charging holes thereof and introducing thereinto of a gas inert to the coke-oven gas, the amount of said inert gas constituting from 15 to 20% of the total amount of the coke-oven gas being discharged.

The above method of charging coke ovens permits the safety of the charging operation to be improved by withdrawing the coke-oven gases from the charging zone and simultaneously introducing a gas inert to the coke-oven gas in an amount sufficient to dilute the coke-oven gas to a safe concentration. At the same time the content of the nitrogen oxides in the coke-oven gas is also lowered, which makes the latter suitable for the use in nitrogen fertilizer production. Furthermore, the gases containing dust are isolated from the gas withdrawing system of the coke-oven battery and, hence, are prevented from clogging the system with dust and coal particles. With the efficiency and safety of the smokeless charging operation thus improved, the proposed process can be used under various operating conditions, for instance, for charging both a wet coal charge and dried one.

It is expedient that the coke-oven gas be burned and the resultant combustion gas be used as an inert gas, thereby raising efficiency of the process.

These and the other objects of the invention are also attained in the present invention.

The object of the invention is also accomplished by a coal-charging machine comprising a frame with an undercarriage, hoppers for the coal charge, the number of the hoppers being equal to the number of the charging holes of the coking chamber, said hoppers being mounted on said frame and having each in the upper part a coal feed device and in the lower part a coal discharging device, the centres of the discharging holes of the discharging devices of the extreme hoppers for charging the coking chamber are displaced in the direction of movement of the coal-charging machine relative the centres of the discharging holes of the discharging devices of the middle hoppers for completely charging the other coking chamber for a distance equal to the distance between the longitudinal axis of the coking chamber being charged and the coking chamber being completely charged. According to the invention the coal charging machine is provided with a means for withdrawing gases from the coking chamber through the middle charging holes thereof, which means being disposed in a row with the extreme hoppers, and each middle hopper having a sleeve mechanically connected with a blowing means, and a gas-withdrawing sleeve connected to a gas withdrawing means for withdrawing gases from the coking chamber through the middle holes thereof.

The above coal discharging machine is simple in design and permits the fire and explosion safety of the coal charging operation to be improved by withdrawing the coke-oven gases from the charging zone and introducing a gas inert to the coke-oven gas into the zone of the complete charging.

It is expedient that the said means for withdrawing gases from the coking chamber through the middle charging holes thereof include ventilation gas-purifying means and through a gas burner be connected with the said blowing means, which will raise the efficiency of the process at the expense of using the combustion products resulting from burning the coke-oven gas as an inert gas.

BRIEF DESCRIPTION OF THE DRAWINGS

The invention will now be described in greater detail with reference to embodiments thereof in conjunction with the accompanying drawings, wherein.

DETAILED DESCRIPTION OF THE INVENTION

Figure 3:
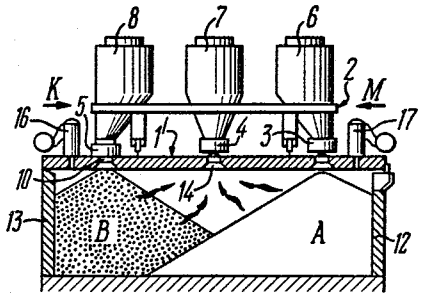
FIG. 3 shows the relative positions of the coking chamber and the coal-charging machine during charging the coking chamber through the extreme charging hole located on the coke discharge side of the coke-oven battery, and withdrawing charging gases through the middle charging hole.

EXAMPLE (carrying out the proposed method is considered under normal operating conditions)

For charging a coke-oven battery 1 (FIGS. 1 and 2) with a coal charge the coal-charging machine 2 is positioned thereon so that the centres of the discharging holes of the discharge devices 3, 4 and 5 of its hoppers 6, 7 and 8 respectively, coincide with the centres of the charging holes 9 and 10 of the coking chamber 1′ to be charged and of the charging hole 11 of the coking chamber 1″ to be completely charged, the coking chamber doors 12 and 13 and the covers of the charging holes 9, 10 and 11 being closed.

Charging the next successive coking chamber 1′ with coal is done from the extreme end hopper 6 of the coal-charging machine through the extreme end charging hole 9 of the said chamber 1′, located on the coke pusher side shown by arrow M. To start the charging, the cover from the charging hole 9 is removed, the coal discharging device of the coal-charging machine is lowered upon the hole, and the gate of the hopper 6 is opened. The coal pours by gravity from the hopper into the coking chamber and forms therein a heap in the form of a cone A. Simultaneously, gases evolving from the coal being charged are withdrawn through the middle charging hole of the chamber and passed through the pipe 15 to the ventilation gas-purifying apparatus incorporated in the gas withdrawing means for removing gases from the coking chamber through the middle charging holes (disclosed below). After the coal is completely discharged from the hopper 6, the gate thereof is closed, the coal discharging device is raised, and the charging hole 9 is closed with the cover. During the above operation the ascension pipes 16 and 17 of the coke oven, located on the coke pusher side and the coke discharge side (shown by arrow K) respectively, are closed.

Figure 1:
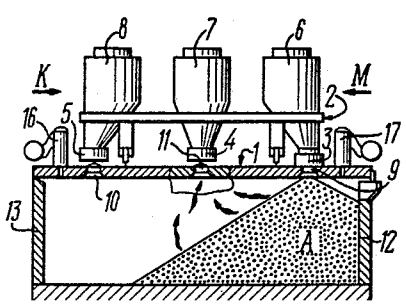
FIG. 1 schematically represents the relative positions of the coking chamber and the three-hopper coal charging machine during charging the coking chamber through the extreme charging hole located on the coke pusher side of the coke-oven battery, and withdrawing charging gases through the middle charging hole.
Figure 2:
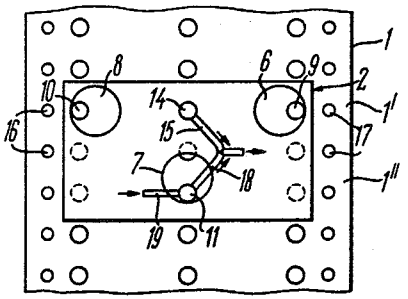
FIG. 2 is a top view of FIG. 1.

After this, the coal is charged to the same coking chamber through the extreme charging hole 10 thereof from the hopper 8 on the coke discharge side of the coke oven battery (FIGS. 1, 2 and 3). Removing the cover from the charging hole, lowering the coal charging device thereupon and opening the gate of the hopper 8 are done in the above sequence. The coal pouring from the hopper 8 into the coking chamber forms a heap in the form of a cone B. The gases evolving from the coal being charged are withdrawn through the middle charging hole 14 of the same coking chamber.

Figure 4:
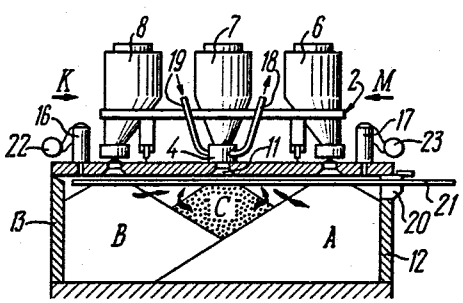
FIG. 4 shows the relative positions of the coking chamber and the coal-charging machine during completely charging the coking chamber through the middle charging hole, withdrawing gases therethrough and leveling the coal charge in the coking chamber.

Simultaneously with charging the coking chamber with coal from the hoppers 6 and 8 through the extreme charging holes 9 and 10 of the said chamber, the previous (relative to the sequence of the charging operation) coking chamber 1' is completely charged through its middle charging hole 11 from the middle hopper 7 (FIGS. 2 and 4), with the cover of the charging hole removed, the coal charging device of the hopper lowered, and the gate of the hopper opened. The coal pouring from the hopper into this coking chamber forms a heap in the form of a cone C between cones A and B formed as a result of the first-stage charging. The gases evolving from the coal being charged are withdrawn through the discharging device 4 and the pipe 18. At the same time into a gas jacket of the said discharging device through a pipe 19 is introduced a gas inert to the coke-oven gas, for instance, such as a fume gas, nitrogen, or preferably combustion gases of the coke-oven gas, with the amount of said inert gas being introduced constituting from 16 to 20% of the total amount of the coke-oven gas being discharged. In the case of using combustion gas as an inert gas the latter is fed from the gas purifying apparatus (disclosed below) with the aid of a blowing means. After the complete charging of the coking chamber is over the coal therein is levelled with the aid of a levelling bar 21 introduced into the coking chamber 1'' through the hole 20 in the door 12. As a result of such levelling, between the coal charge and the chamber roof is formed a passage for gases to flow through. The charging operation finished, the middle charging holes 11 and 14 of the coking chambers 1' and 1'' are closed and the valves of the ascension pipes 16 and 17 are opened so that gases resulting from the coking process are withdrawn through said ascension pipes to the collection mains 22 and 23.

Figure 5:
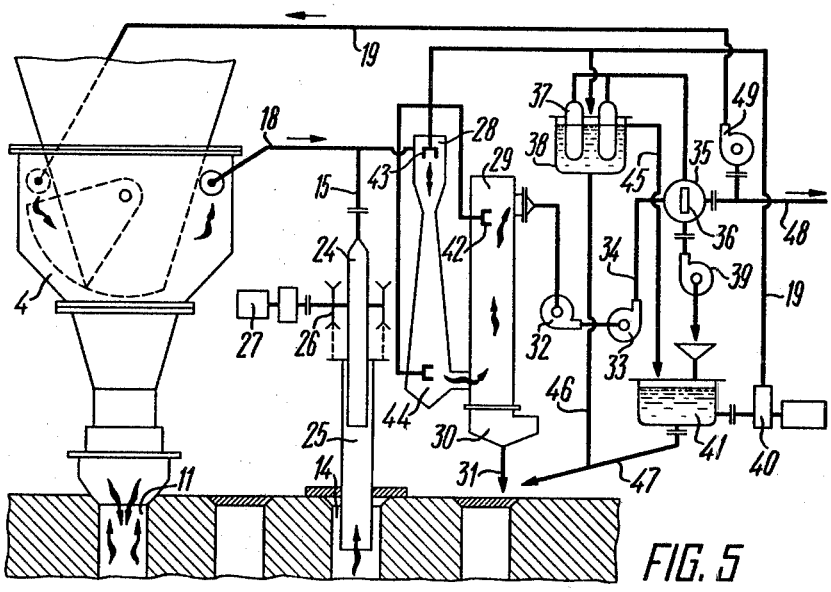
FIG. 5 is a gas flow diagram of the gas withdrawal from the coking chamber through its middle charging holes with the aid of a special means including a ventilation gas purifier.

As has been indicated above, the gases evolving from the coal during the charging of the coking chamber 1' and complete charging of the coking chamber 1'' are passed to the ventilation gas purifying apparatus of the coal-charging machine, wherein the said gases are purified, burned and discharged into the atmosphere (FIG. 5). Withdrawing gases from the coking chamber is effected with the aid of a telescopic pipe including a stationary part 24 and movable part 25 which is introduced into the charging hole 14 of the coking chamber. The movable part 25 of the telescopic pipe is connected with the lifting winch 26 having a drive 27. The stationary part 24 of the telescopic pipe is communicated with the pipe 15.

From the charging device 4 of the hopper 7 the charging gases are withdrawn through the pipe 18 of the ventilation gas purifying apparatus. The both pipes 15 and 18 are connected with a gas washer 28 wherefrom the washed gases are passed to a gas separator (scrubber) 29 provided with a slime collector 30 having a tap 31 for discharging the slime. The slime is periodically discharged into a collector (not shown) located under the coal bin. The gas flow in the purifying system is produced by fans 32 and 33 connected in series. An exhaust pipe 34 of the fan 33 is led up to a gas burner 35 having an igniter 36. To maintain a flame in the gas burner 35 the latter is connected to an additional fuel source such as, for example, a gas cylinder disposed for safety in a container 38 filled with water. The air for burning is fed by a fan 39.

To cause the dust and coal particles contained in the charging gases to more intensely settle down the ventilation gas purifying apparatus is provided with a pumping device 40 for taking water from a water tank 41 located on the coal-charging machine. Filling the tank 41 with water is effected during the filling the hoppers of the coal charging machine with coal under the coal bin. During the charging of the coking chamber, with the ventilation gas purifying apparatus being operated, water is delivered under pressure by the pumping device 41 to sprayers 42, 43 and 44 located in the separator 29 and the washer 28 respectively. Excess water from the container 38 overflows into the tank 41 through a pipe 45, and the slime from these tanks is removed through pipes 46 and 47.

The charging gases after being purified, are burned in the gas burner 35 and discharged through a pipe 48 into the atmosphere. A part of the combustion gases, constituting from 15 to 20% of the total amount of the gases being discharged is passed by a blowing device which is an additional fan 49 through a pipe 19 to a gas chamber of the charging device 4. In the gas chamber the charging gases are mixed with the combustion gases fed through the pipe 19 so that they are diluted to a safe concentration. At the same time to prevent ingress of the ambient air into the charging device 4 and into its gas chamber, a positive pressure is provided therein. All the above measures make it possible to provide for a full fire and explosion safety of the process, to improve the efficiency of charging operation, and to prevent ingress of nitrogen oxides, dust and coal particles into the gas collection mains wherethrough the coke-oven gas is withdrawn.

Since the charging gas from the coking chamber 1'' being completely charged is withdrawn through the middle charging hole thereof and the charging device 4 of the hopper 7 (FIGS. 1, 4 and 5), and from the coking chamber 1' being charged through the middle charging hole 14 and a special device (disclosed below), the gas chambers of the discharging devices 3 and 5 of the extreme end hoppers 6 and 8 are closed, i.e. the openings through which the said gas chambers communicate with the pipes 18 and 19 are closed.

As has been mentioned above, the proposed method has been described as carried out under the normal operating conditions, which implies the charging of all the coking chambers except for the first two and the last two chambers of the coke-oven battery. Since the discharging devices of the extreme hoppers and the middle hopper of the coal-charging machine are displaced for a distance equal to the distance between the longitudinal axis of the coking chamber being charged and the coking chamber being completely charged, the coal-charging machine has to be additionally shifted. Charging the outer coke ovens is scheduled for the begining and the end of the whole charging cycle of the coke-oven battery.

The above example also applies to the case of charging the coke ovens having 4 and 5 charging holes, in which case completely charging the coking chamber through the middle charging holes is effected as in the case of the coking chamber having three charging holes, considering middle holes as a single one. Whatever the number of the charging holes, the following general rule should be observed: the total capacity of the extreme hoppers of the coal-charging machine should constitute 75–80% of the total capacity of all the hoppers. This is accounted for by the fact that the cone-shaped heaps of coal formed as a result of pouring the coal through the extreme end charging holes constitute 75–80% of the total amount of the coal charge of the coking chamber.

As can be seen from the above, the proposed method can be carried out with the aid of the coal-charging machine 2 (FIGS. 1, 6, 7, 8), comprising hoppers 6, 7 and 8 for the coal charge. The number of the hoppers mounted on the coal-charging machine is equal to the number of the charging holes 9, 10, 11 of one coking chamber. The number of the charging hopper depends on the type of a coal-charging machine (three, four, five and more).

Figure 9:
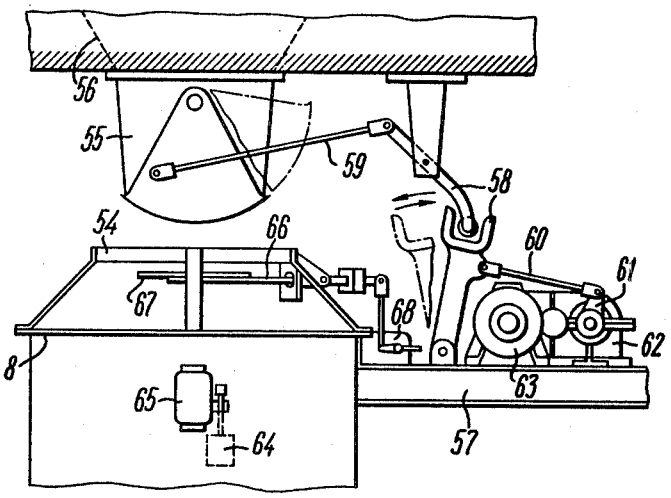
FIG. 9 shows the coal feed device of the coal charging machine hopper, and the closing device of the coal bin, side view.
Figure 10:
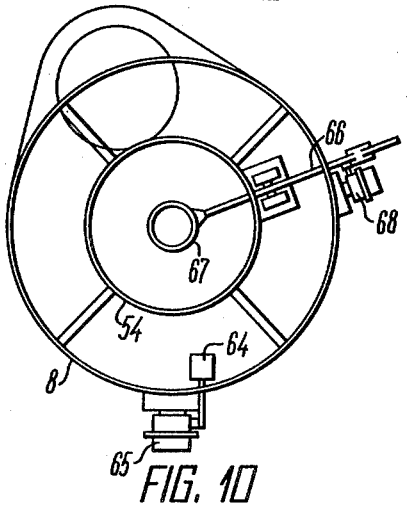
FIG. 10 is a top view of FIG. 9.

The coal-charging machine has a frame 50 (FIGS. 6, 7) in the form of a gantry carriage installed on the undercarriages 51, 52 and travelling along the rails 53 laid on the top of the cokeoven battery. Each hopper has a coal feed device (FIGS. 9 and 10) located in the upper portion thereof.

The coal feed device is a doser 54 made in the form of a ring fixed coaxially with the centre of the charging hole of the hopper. The circular edge of the doser 54 is adapted to form a cone of the coal charge pile in the hopper and control an amount of the coal charge therewithin. Each hopper of the coal-charging machine should be provided with a means for opening the gate 55 of the coal bin 56 (FIGS. 7 and 9), which means is mounted on the platform 57 and has a lever 58 which operates the gate 55 through a rocker 58 and a rod 59. The rocker 58 in its turn is actuated by a rod 60 and a crank 61 of the drive including a reduction gear 62 and an electric motor 63.

The drive is switched on by the operator of the coal-charging machine, and is switched off automatically when the amount of coal in the hopper reaches its predetermined value. At the moment when the height of the coal in the hopper reaches a predetermined level the coal acts upon the lever 64 of the limit switch 65, in response to which the latter switches off the electric motor. The coal flowing from the coal bin 56 continuously acts on the coal flow sensor made in the form of a balance 66 with a ring 67, and therethrough on the limit switch 68. In the case of interruption of the coal flow as a result of hanging of the coal in the coal bin 56, the coal flow sensor produces a signal to actuate a means for stirring the hanging coal.

Figure 6:
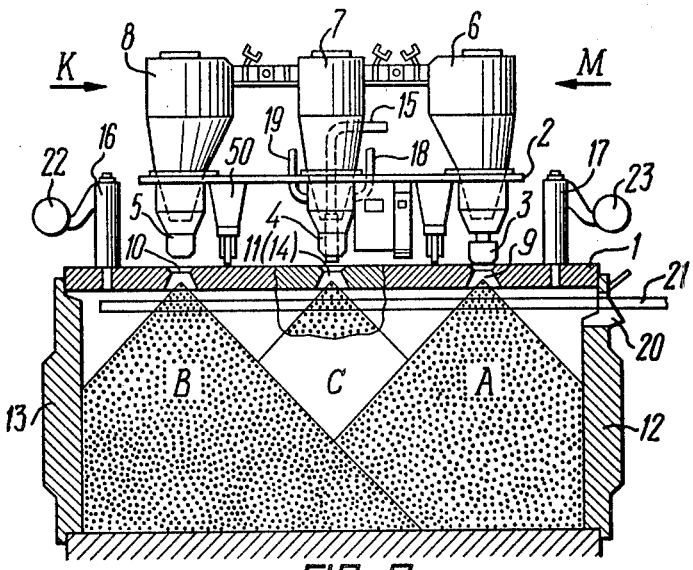
FIG. 6 is a front view of the coal-charging machine, illustrating the position thereof on the coke-oven battery during the charging thereof.
Figure 11:
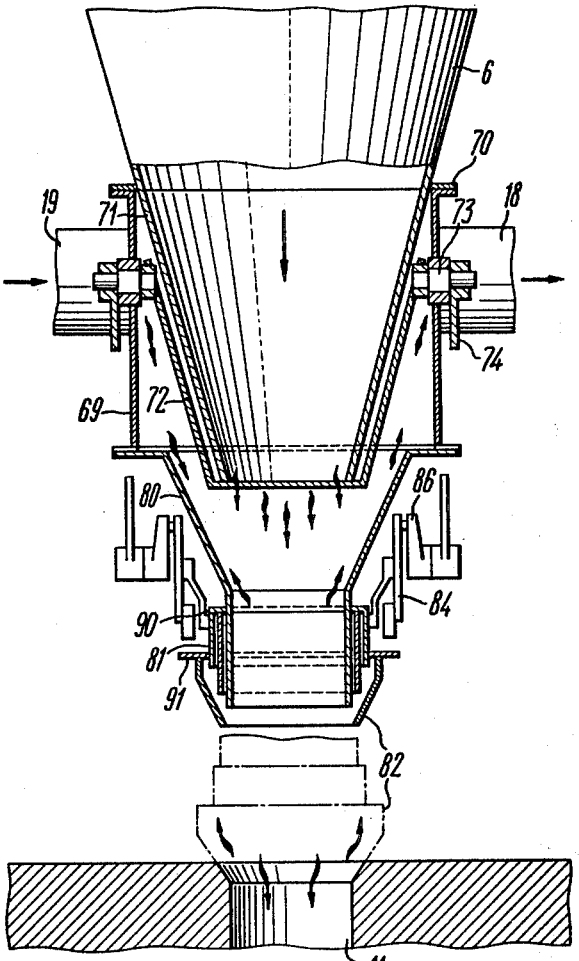
FIG. 11 is a front view of the coal discharging device of the coal charging machine hopper.
Figure 12:
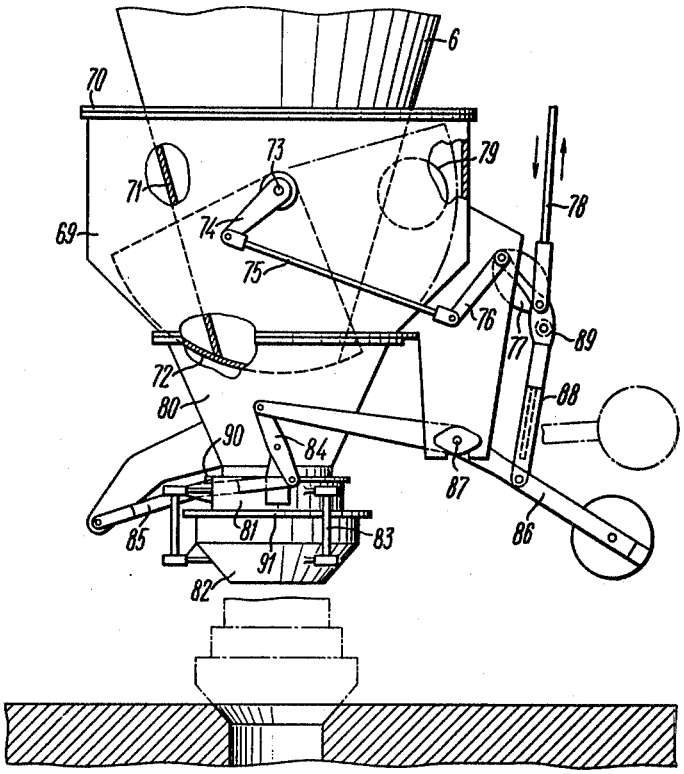
FIG. 12 is a side view in FIG. 11.

Each hopper is provided with a discharging device (FIGS. 11 and 12) located in the lower portion thereof, each of which discharging devices has a housing 69 connected by means of a flange 70 to the lower part of the hopper 6 (7 and 8). Located within the housing is a discharging chute 71 having a round in cross section outlet opening and adapted for being closed by a gate 72. The gate 72 is hinged by means of a pivot 73 for rotation under action of levers 74, 75, 76 and 77, interacting with a driving rod 78. On the side walls of the housing there are provided flanges 79 for connection to the pipe 18 and 19 (FIGS. 5, 6). The flanges installed on the extreme end hoppers 6 and 8 of the coal-charging machines (FIG. 6) are closed. The flanges on the middle hopper 7 are open. To the lower portion of the housing 69 is connected extensible guiding device communicating the hopper with the coking chamber during the charging operation and containing a stationary sleeve 80 with a conical and cylindrical portions, and two movable sleeves 81 and 82. The sleeve 82 is connected with the aid of suspensions 83 to the sleeve 81 which in its turn is connected with levers 84, 85 and 86. The lever 86 is set on an axle 87 and movably connected through a rod 88 and a lever 89 with the driving rod 78. Circular gaps between the said sleeves are closed with sealing means made in the form of movable rings 90 and 91. The gas chamber of the coal discharging device is a cavity defined by the housing 69 walls, conical portion of the sleeve 80 and walls of the chute 71 and the gate 72.

Figure 13:
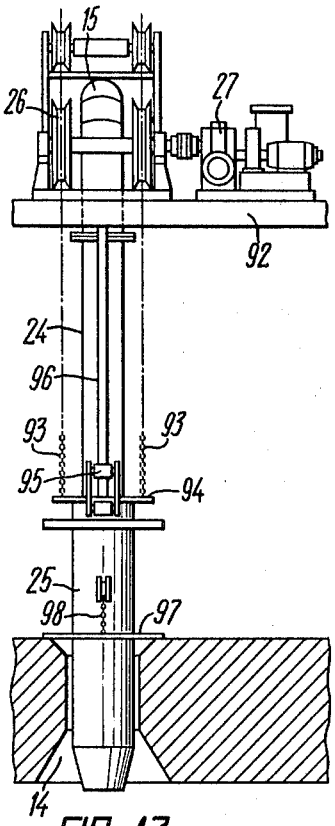
FIG. 13 is a front view of the extensible gas withdrawing device in the operating position i.e. introduced into the charging hole of the coking chamber.
Figure 14:
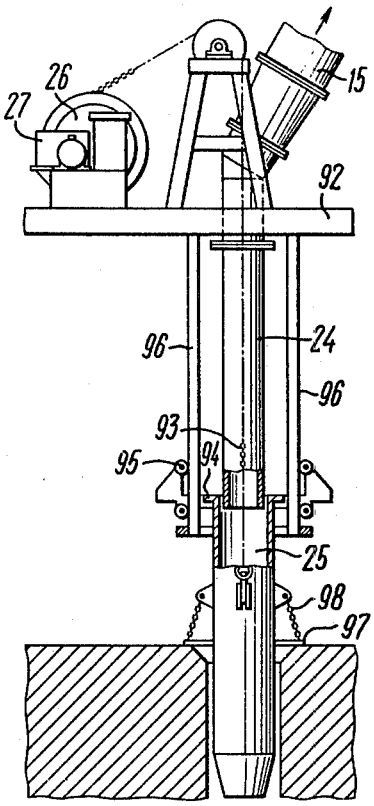
FIG. 14 is a side view of FIG. 13.

For withdrawing coke-oven gases from the coking chamber through the middle charging hole 14 located on the same axis with the extreme hoppers 6 and 8, the coal-charging machine is provided with a special means including a telescopic (extensible) pipe, a pipe 15 and a ventilation gas-purifying apparatus. The telescopic pipe comprises a stationary part 24 and a movable part 25 (FIGS. 5, 13 and 14). The stationary part 24 of the telescopic pipe is communicated with the pipe 15 for passing gases to be purified to the gas purifying apparatus (FIG. 5) and rigidly connected on the platform 92 of the coal-charging machine. The movable part 25 of the telescopic pipe is suspended on chains 93 fastened with their one end to the flange of the telescopic pipe and with the other end to the winch 26. The flange 94 has guiding rollers 95 for guiding the movable parts 25 of the telescopic pipe when the latter is moving in guiding elements 96 secured on the platform 92. A circular gap between the walls of the movable part 25 and the charging hole 14 of the coking chamber is closed by a circular plate 97 connected by means of chains 98 to the movable part 25 of the telescopic pipe.

Figure 7:
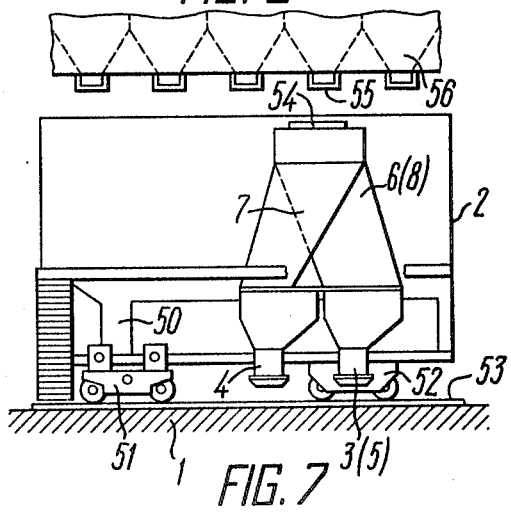
FIG. 7 shows the position of the coal-charging machine under the coal bin while it is being loaded with coal.
Figure 8:
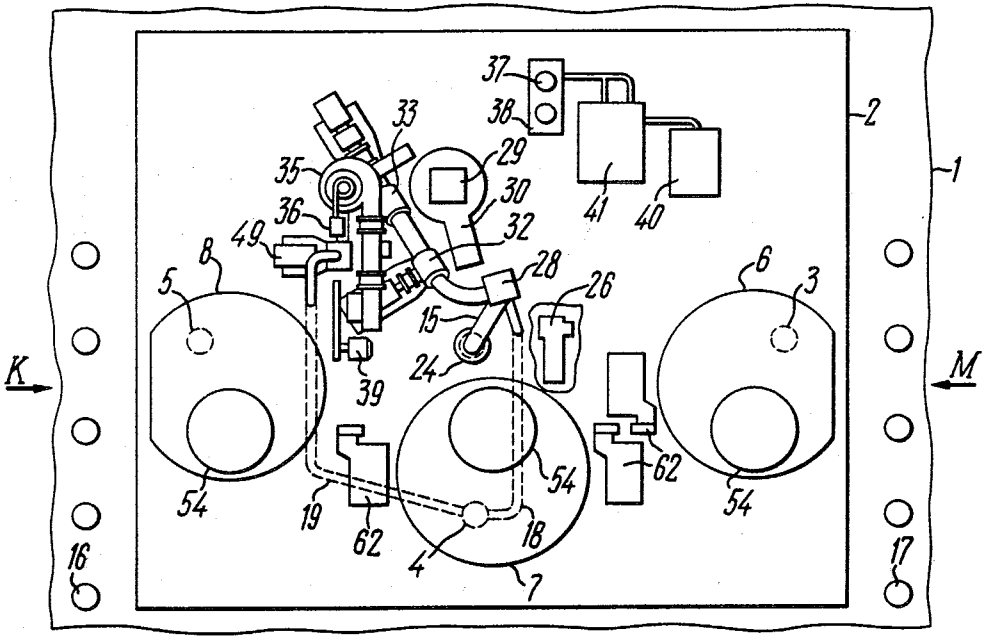
FIG. 8 is a plan view of the gas withdrawing means mounted on the coal-charging machine.

The proposed coal-charging machine operates in the following manner. The charging cycle begins with positioning of the coal-charging machine 2 under the bottom gates of the coal bin (FIG. 7). The coal-charging machine is so positioned that the centres of the coal feed devices 54 of its hoppers coincide with the centres of the bottom gates 55 of the coal bin 56, whereafter the drive 63 is switched on to actuate the lever 58 and to thereby open the bottom gate 55 of the coal bin 56. The coal pours by gravity into the hoppers 6, 7, 8 of the coal-charging machine. The quantity of coal being loaded in each hopper is controlled by the doser 54. In the case of hanging of coal in the coal bin 56 the coal flow sensor automatically switches on the means for stirring the coal in the coal bin (not shown).

After each hopper (6, 7 and 8) is filled with coal, the gate 55 of the coal bin 56 is closed by rotating the lever 58 in the opposite direction. Controlling the charging of the hoppers with coal and operating the drive may be carried out either by an operator or by any known in the art means.

Then the coal-charging machine is moved to a coking chamber from which the coke has been discharged, and positioned thereover so that the centres of the discharge holes of the coal discharging devices 3 and 5 (FIG. 1) of the extreme hoppers 6 and 8 coinside with the centres of the extreme charging holes 9 and 10 of the coking chamber 1' to be charged and the centre of the coal discharging device 4 of the middle hopper 7 with the charging hole 11 of the coking chamber 1'' to be completely charged. The movable part 25 of the telescopic pipe (FIG. 13) will be positioned over the centre of the charging hole 14 of the coking oven to be charged. Before the charging is begun, the covers of the charging holes 9, 10, 11 and 14 are removed.

After that the extensible sleeves 82, 81 of the coal discharging devices of the hoppers 6, 7 and 8 (FIGS. 1 and 12) are lowered onto the charging holes 9, 10 and 11, whereas the movable part 25 of the telescopic pipe of the gas withdrawing means is introduced into the charging hole 14. Charging the coking chamber with coal from the hoppers 6, 7 and 8 and handling the gases are effected in the sequence disclosed in the above description of the proposed method. Before starting the charging operation the drives of the fans 32, 33, 39 and 49 (FIG. 5) of the ventilation gas-purifying apparatus are switched on.

After the charging is over, the gates 72 of the coal discharging devices of the hoppers 6, 7 and 8 are closed (FIG. 12), the extensible sleeves 82, 81 of the coal discharging devices and the movable part 25 of the telescopic pipe (FIG. 13) are raised, the charging holes 9, 10, 11 and 14 are closed with covers and the coal-charging machine is moved to under the coal bin to receive a next batch of the coal charge and positioned thereunder as described above.

It is to be understood that this invention may be variously otherwise embodied within the scope of the appended claims.

We claim:

1. A coal-charging machine comprising a frame with undercarriages; hoppers for containing a coal charge, mounted on said frame, the number of the hoppers being equal to the number of the charging holes of a coking chamber; coal feed devices located in the upper part of said hoppers; coal discharging devices located in the lower part of said hoppers, The centers of the discharging holes of said coal discharging devices of the extreme hoppers for charging a coking chamber, being displaced, in the direction of movement of the coal-charging machine relative the centers of the discharging holes of the coal discharging devices of the middle hopper for completely charging another coking chamber by a distance equal to the distance between the longitudinal axes of a coking chamber being charged and another coking chamber being completely charged; a means for withdrawing coke-oven gases from a coking chamber through its middle charging holes, located in the same row with the extreme hoppers and mechanically connected with each middle hopper, and a blowing device communicating through said middle hoppers with another coking chamber.

2. A coal-charging machine as claimed in claim 1, wherein said means for withdrawing coke-oven gases from a coking chamber through its middle charging holes includes a ventilation gas-purifying apparatus and including a gas burner communicating therewith and with said blowing device.

* * * * *